US009303398B2

(12) United States Patent
Bell

(10) Patent No.: US 9,303,398 B2
(45) Date of Patent: Apr. 5, 2016

(54) SYSTEM AND METHOD FOR INSTALLING SIDING, FENCING AND DECKING MATERIALS

(71) Applicant: Sean William Bell, Seattle, WA (US)

(72) Inventor: Sean William Bell, Seattle, WA (US)

( * ) Notice: Subject to any disclaimer, the term of this patent is extended or adjusted under 35 U.S.C. 154(b) by 0 days.

(21) Appl. No.: 13/833,053

(22) Filed: Mar. 15, 2013

(65) Prior Publication Data

US 2014/0102033 A1 Apr. 17, 2014

Related U.S. Application Data

(60) Provisional application No. 61/653,336, filed on May 30, 2012.

(51) Int. Cl.
*E04B 1/00* (2006.01)
*E04F 13/10* (2006.01)
*E04F 13/08* (2006.01)

(52) U.S. Cl.
CPC ..... *E04B 1/003* (2013.01); *E04F 13/0819* (2013.01); *E04F 13/10* (2013.01)

(58) Field of Classification Search
CPC ..... E04F 13/0805; E04F 13/0864; E04F 13/0803; E04F 13/0841; E04F 13/0842; E04F 13/0846; E04F 13/0812; E04F 13/0876; E04F 13/10; E04F 13/0819; E04D 1/34; E04D 12/004; E04D 1/18; E04D 3/363; E04B 1/003
USPC ..... 52/543, 546, 547, 551, 520, 521, 475.1, 52/476, 478, 483.1, 489.1, 51, 2, 462, 52/747.1, 748.1
See application file for complete search history.

(56) References Cited

U.S. PATENT DOCUMENTS 3,005,293 A * 10/1961 Hunter ..... E04F 13/0805 52/385
3,131,513 A * 5/1964 Grigas ..... E04D 3/362 52/520
3,236,932 A * 2/1966 Grigas ..... E04F 13/0803 174/2
3,903,670 A * 9/1975 Robinson, Jr. ..... E04F 13/0821 52/478
4,047,349 A * 9/1977 Aguilar, Jr. ..... E04F 13/18 52/546

(Continued)

*Primary Examiner* — Brian Glessner
*Assistant Examiner* — Adam Barlow
(74) *Attorney, Agent, or Firm* — Foster Pepper PLLC; Joel B. Ard; P. G. Scott Born

(57) ABSTRACT

A spring clip system for mounting material to a structure includes: a spring clip, a rail and a starter clip. A first end of the spring clip is threaded through a hole in the rail while a second end of the spring clip is placed over the edge of siding material. A bottom portion of the spring clip holds the top edge of siding board and a top portion is used to hold the bottom of next siding board. The first end of the clip is bent back over the edge of the hole in the rail against the force of the spring action and snapped over the outer edge and into a notch. The starter clip is holds the bottom edge of the first siding board. The starter clip is held in place by a pin and receives the bottom of the first siding board.

3 Claims, 5 Drawing Sheets

(56) References Cited

U.S. PATENT DOCUMENTS 4,054,012 A * 10/1977 Paradisi ..... E04F 13/0864 52/276
4,134,244 A * 1/1979 Sjolander ..... E04B 9/36 52/478
4,288,958 A * 9/1981 Chalmers ..... E04F 13/0864 52/478
4,961,295 A * 10/1990 Kosch, Sr. ..... A47F 5/0846 211/94.02
5,150,555 A * 9/1992 Wood ..... E04F 13/0864 52/544
5,392,579 A * 2/1995 Champagne ..... E04D 1/34 52/520
5,564,245 A * 10/1996 Rademacher ..... E04F 13/0864 52/520
5,675,955 A * 10/1997 Champagne ..... E04F 13/0864 52/519
6,044,609 A * 4/2000 Kim ..... E04F 13/0864 52/478
6,125,592 A * 10/2000 Hickey ..... E04D 1/045 52/543
6,164,467 A * 12/2000 DePottey ..... A47F 5/0846 211/189
6,725,618 B2 * 4/2004 Albracht ..... E04F 13/0864 248/222.41
6,990,778 B2 * 1/2006 Passeno ..... E04F 13/14 52/385
7,823,350 B2 * 11/2010 Valle ..... E04C 3/07 52/351
8,096,091 B2 * 1/2012 Cristina ..... E04F 13/0864 52/478
2006/0213142 A1 * 9/2006 Albracht ..... E04D 13/158 52/543

* cited by examiner

SYSTEM AND METHOD FOR INSTALLING SIDING, FENCING AND DECKING MATERIALS

PRIORITY CLAIM

The present application claims the benefit of the U.S. Provisional Patent Application Ser. No. 61/653,336 filed May 30, 2012. The foregoing application is herein incorporated by reference in its entirety.

FIELD OF THE INVENTION

This invention relates to siding panel systems for building structures, and fencing, decking and objects or materials that are to be fastened to structures. More particularly, this invention relates to horizontal siding panels, fencing boards, or deck boards and a clip and rail system that eliminates the need for screws or nails for attaching the siding, fencing, or decking material to the structure.

BACKGROUND OF THE INVENTION

There are rain-screen or ventilated siding systems available for mounting siding to building structures and hidden fastener systems available for attaching fencing and decking boards to structures. Most of these systems require the use of screws or nails to attach the siding material. Some of these systems use a clip device that is screwed to a rail system, thus eliminating the need for screws or nails to attach the siding material, as shown, for example, in U.S. Pat. No. D617,011. Although these existing clip systems eliminate the need for nails or screws to attach the siding material, each clip must be measured for placement and then each clip individually screwed to the rail system.

Accordingly, there is a need for mounting system that is simple to install and use, requires few or no tools and provides for accurate mounting of siding, fencing and decking materials.

SUMMARY OF THE INVENTION

In accordance with the present invention, a clip system which includes a spring clip, a rail, and a starter clip, which can be easily manufactured is provided in combination with siding panels, fencing boards, decking boards or other boards or materials, for securing to a building or structure.

The clip system includes a spring clip made of a material with inherent memory properties for securing the siding, fencing, or decking material. The spring clip may be made from tempered stainless steel or other material with similar properties. It has a shape that engages the rail and spring properties that hold the siding material firmly in place. One end of the clip is shaped in such a way so that it can hold both the top of one siding board and the bottom of another, while the other end of the clip is manually forced and snapped over the edge of the rail.

The rail is made from stainless steel or other material with similar properties. The rail is attached to a structure in the vertical direction by the use of screws or other adequate fasteners. The rail also has openings cut into it at regularly spaced intervals that match the spacing of the siding material to be used. After the rails have been attached to the structure, one end of the spring clip is threaded through the hole in the rail while the other end of the clip is placed over the top edge of the siding material. The end of the spring clip that is placed over the siding material is in the shape of a hoop or square with rounded corners. the bottom half of the hoop holds the top edge of the siding board below it and the top half of the hoop is free waiting for a groove cut into the bottom of next siding board to be seated over it.

After the spring clip has been accurately placed to hold the siding or other material, the end of the clip that was threaded through the opening in the rail is manually bent back over the edge of the hole in the rail against the force of the spring action inherent in the material and snapped over the outer edge of the rail. The outer edge of the rail has a slight notch cut into the material so the snapped end of the clip does not interfere with the next coarse of siding or other material that is subsequently seated over the waiting hooped end of the clip and secured on top by the next spring clip to be placed.

The third part of the system is the starter clip. Since the spring clip relies on the existence of the edge of a siding board to push against, a starter clip is preferred to hold the bottom edge of the first siding board. The starter clip is made from a bent piece of stainless sheet metal or other material with similar characteristics. In profile the starter clip looks like the constellation big dipper. The flat portion of the starter clip has a slice cut into it at mid point that slips over the fin portion of the rail that has the hole in it for the spring clip. The end of the flat section of sheet metal is rolled over 180 deg. to form a tube or half pipe. This half pipe opening is to align at a 90 deg. angle with edge of the first opening located at the bottom of the rail. This alignment allows a fastening pin or nail to be pushed through the half pipe opening in the starter clip then continuing through the first opening in the rail and then finishing through the other end of the half pipe hole in the starter clip thus locking the starter clip to the rail. The remainder of the fastening clip is in the shape of a trough with open ends. This open ended trough receives the bottom of the first siding board.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

In accordance with a preferred embodiment of the present invention, a spring clip system and method for attaching siding to building structures, fencing, or decking is provided. As will be discussed more fully below, the spring clip system and method relate to horizontal siding panels, fencing boards, or deck boards and a clip and rail system that eliminates the need for screws or nails for attaching the siding, fencing, or decking material to the structure. In addition, the system and method automatically provides for proper alignment, eliminates the need to make measurements for nailing and results in no exposed screws or nails.

In addition to the foregoing and as will become apparent from the following discussion, the spring clip system is easy to manufacture. It provides an economical solution for installing a rain-screen, or vented siding system, fencing, and/or decking solution. The spring clip system attaches the siding, fencing, or decking material without the use of screws or nails, and thus eliminates the need for power tools. Also, the system is self aligning thus eliminating the need for measuring and spacing the siding, fencing, or decking boards. Further, the siding, fencing, and/or decking material is not damaged by screws or nails during system installation so that the siding material and the clip system are reusable.

As will be further explained below, the clip system of the present invention requires no tools once rails have been attached to the building structure. Only the fingers of the installing contractor or worker are required to attach the starter and spring clips and to bend and snap the spring clip over the rail.

Figure 1:
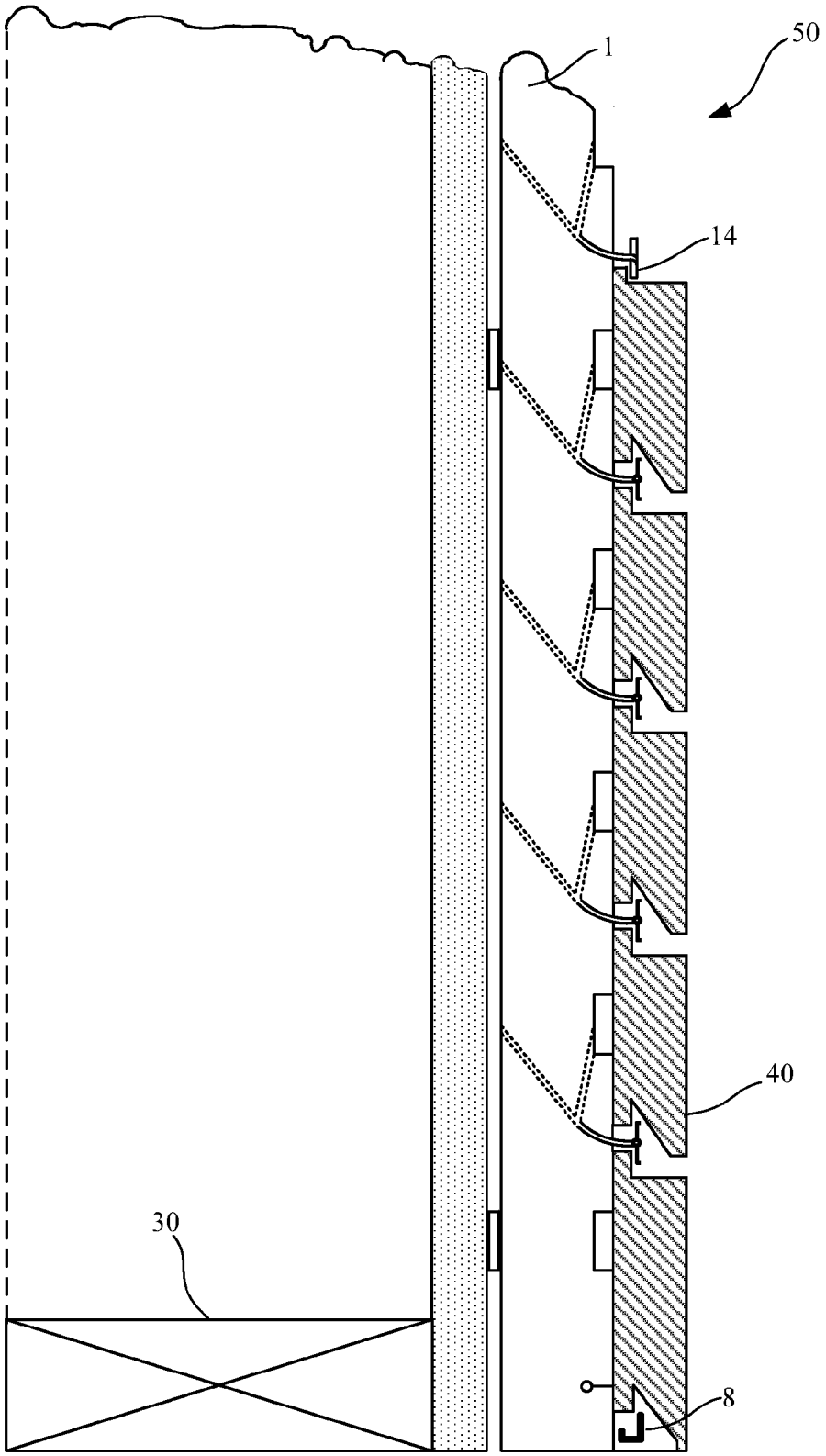
FIG. 1 is an elevation view in partial cross section of the combination of siding, rail, starter clip, and spring clip device on the side of a structure. Drawing is not to scale (NTS)
Figure 2:
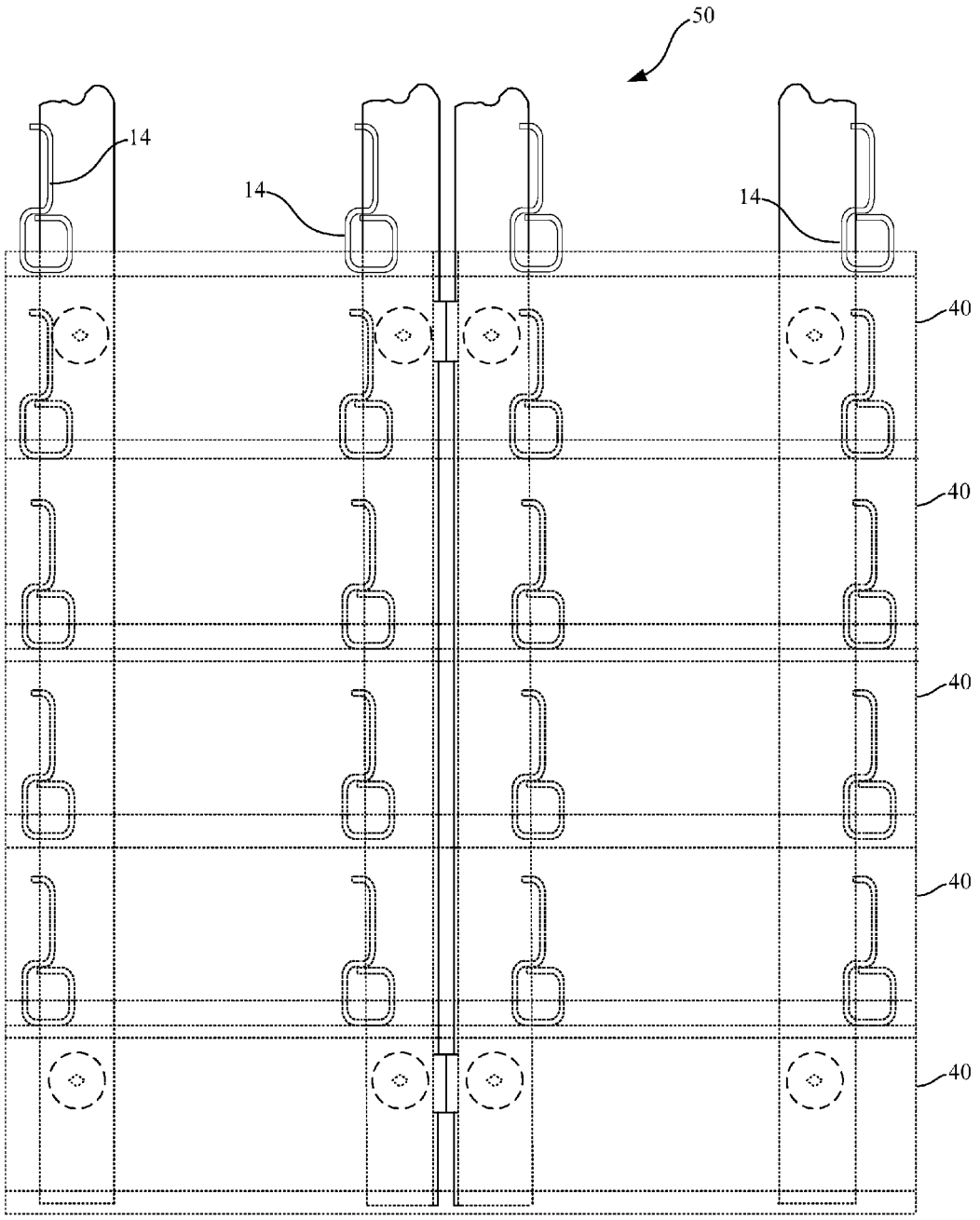
FIG. 2 is an elevation of the combination of the siding, rail, starter clip, and spring clip device. Drawing is not to scale (NTS)

FIGS. 1 and 2 illustrate in section and elevation the placement and location of various parts that make up the clip system 50 as attached to the side of a structure 30 for mounting siding to the structure 30. As illustrated in FIG. 1, wood type siding 40 is being mounted and the spring clip system 50 is appropriately designed for this type of siding. It is understood, however, the spring clip system 50 may conform to, and may be used to mount many different types of siding styles and materials, such as by way of example, fencing, decking and other natural and man-made materials. FIGS. 1 and 2 are for illustrative purposes and for reasons of clarity are nor necessarily drawn to scale.

Figure 3C:
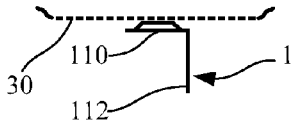
FIG. 3C is a top view of the rail.
Figure 3A:
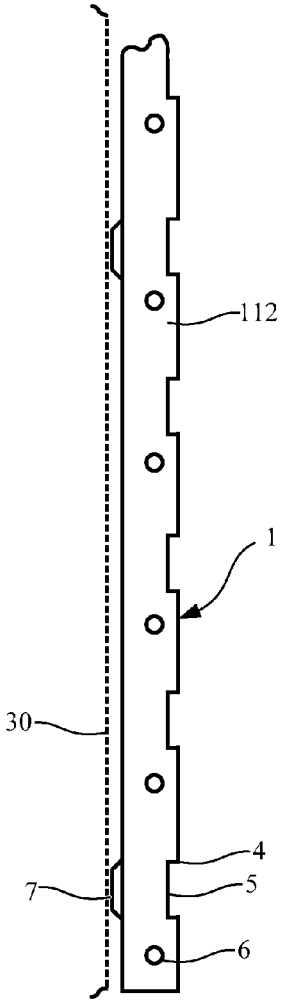
FIG. 3A is a front view of the rail.
Figure 3B:
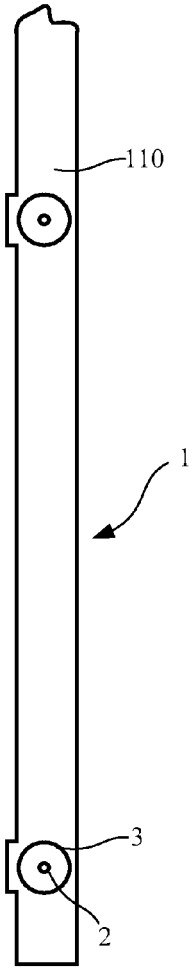
FIG. 3B is a side view of the rail.
Figure 4A:
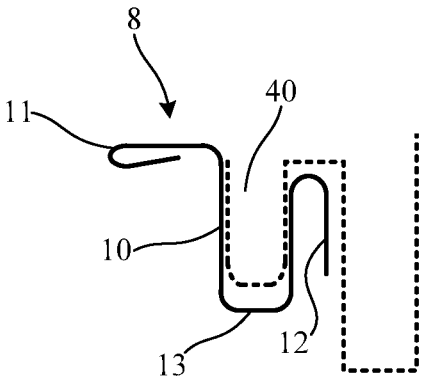
FIG. 4A is a side view of the starter clip device.
Figure 4B:
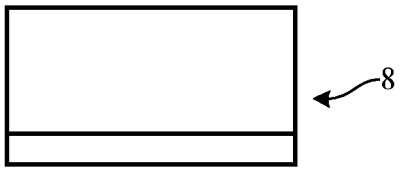
FIG. 4B is a front elevation view the starter clip device.
Figure 4C:
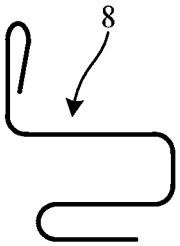
FIG. 4C is another side view of the starter clip device.
Figure 4D:
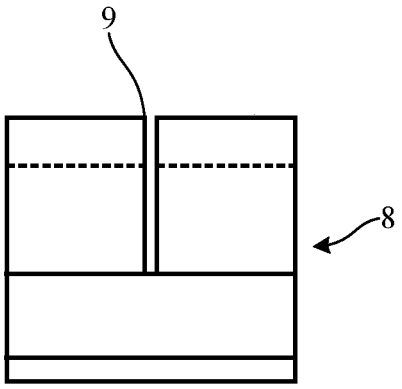
FIG. 4D is top view of the starter clip device.

FIGS. 3A, 3B and 3C are a front view, side view, and top view respectively of rail device 1. In the embodiment depicted in FIGS. 3A, 3B and 3C, the rail device 1 is preferably made of a thin sheet metal or other material, bent at 90 deg. with one leg 110 of the rail device 1 attached parallel to the structure and the other leg 112 of the rail device 1 protruding away from the structure 30 at a substantially right angle. The rail device 1 includes a mounting hole 2 inside of an off-set divot 3 on leg 110. The off-set divot 3 elevates the body of the rail 1 away from the structure to allow for lateral air movement between the rail device 1 and the structure 30. Located on the leg 112 of the rail device 1 that is at right angles to the structure 30 are set teeth 4, hook seat 5, and spring clip fulcrum hole 6. The set teeth 4 are very small points cut or stamped into the sheet metal during the fabrication process of the hook seat 5 and the rail device 1. The purpose of the set teeth 4 is to penetrate very slightly in to the back of the siding material (40, not shown) after the siding material 40 has been clamped in to position, preventing the siding material 40 from moving horizontally. The hook seat 5 is a shallow notch cut into the edge of the rail device 1 which allows the end of spring clip 14 (FIGS. 5A and 5B) to snap over the edge of the rail device 1 without interfering with the siding material 40. The spring clip fulcrum hole 6 is a hole located in the leg 112 of the rail device 1 that is perpendicular to the structure 30. The purpose of the spring clip fulcrum hole 6 is to resist the spring force which is applied by the spring clip 14 and to provide accurate spacing for the siding material 40.

Figure 5A:
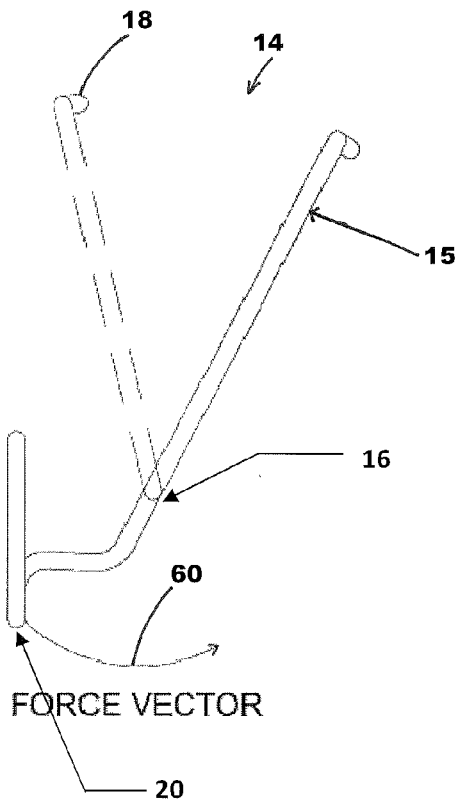
FIG. 5A is a side view of the spring clip device.
Figure 5B:
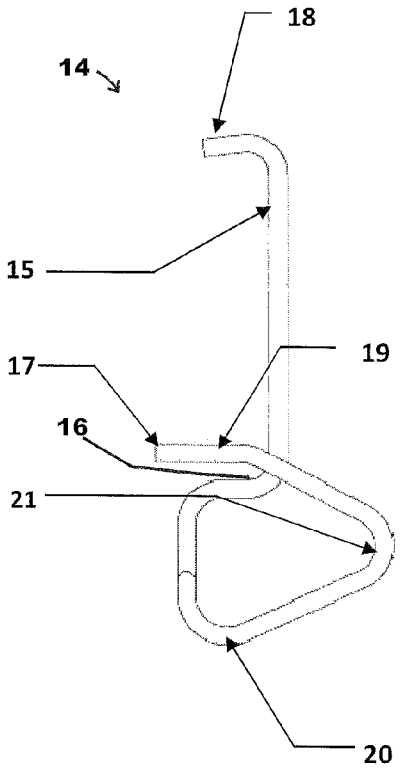
FIG. 5B is a front view of the spring clip device.

FIGS. 5A and 5B are a front view and side view respectively of the spring clip device 14 of the spring clip system 50. In accordance with a preferred embodiment of the present invention, the spring clip device 14 is made of tempered stainless steel wire or other material with similar strength and memory properties. It comprises a set arm 15, a fulcrum seat 16, a set tooth 17, a set seat 19, a retention hook 18, a compression bar 20, and gap spring 21.

To attach the spring clip device 14 to the rail device 1, the set arm 15 and the retention hook 18 are threaded through the fulcrum hole 6 to the point where the fulcrum seat 16 is located within the fulcrum hole 6. During the act of threading the set arm 15 and the retention hook 18, the compression bar 20 is guided into/on to the waiting siding material 40. Once the compression bar 20 and the fulcrum seat 16 have been accurately guided and located into position the set arm 15 is pulled back away from the structure 30 against the force of the spring action that is applied to the fulcrum hole 6 and the fulcrum seat 16. This spring action is illustrated in FIG. 5A by the arrow 60 labeled "force vector". When the retention hook 18 has been forced back far enough to clear the hook seat 5 the retention hook 18 is moved laterally so that the retention hook 18, when released, can rest on the hook seat 5. Because of the geometry of the spring clip device 14 and the location of the fulcrum seat 16 when the retention hook 18 is set over the hook seat 5, the spring clip device 14 produces downward and inward motion in the compression bar 20 which applies a constant compressive force to the siding, fencing, or decking material 40 and to the set teeth 4 and the rail device 1. Because the siding, decking, or fencing material 40, or a portion thereof, is located between the compression bar 20 and the set teeth 4 the siding, decking, or fencing material is held or pinched firmly in place by the spring clip device 14 and rail device 1.

FIGS. 4A, 4B, 4C and 4D illustrate various views of starter clip 8. In accordance with a preferred embodiment of the present invention, the starter clip 8 is made from stainless steel sheet metal or some other material with similar properties and comprises a set slot 9, a spring flange 10, half pipe 11, a siding set 12, and a siding seat 13.

When installed, the siding slot 9 is placed over the arm of the rail device 1 that is perpendicular to the structure 30, this helps prevent lateral siding movement. After the siding slot 9 has been placed over the arm of the rail device 1 the half pipe 11 is aligned with the lowest fulcrum hole 6 located on the rail device 1. After the half pipe 11 and the fulcrum hole 6 have been aligned, an 8*d* penny stainless steel nail, or any other convenient cotter pin-like component, is pushed through the half pipe 11 and the fulcrum hole 6 and the exposed tip of the nail is bent over to prevent unwanted removal. The half pipe 11 and the fulcrum hole 6 do not align exactly until slight pressure is applied to the spring flange 10. The slight misalignment of the set half pipe 11 and the fulcrum hole 6 causes the spring flange 10 to bend slightly which causes the siding set 12 to move up and in towards the structure slightly. When the bottom edge of the first row of siding material 40 is pushed on to the siding set 12 and the top edge of the siding material 40 is clamped down with the first row of spring clip devices 14 the upward and inward pressure caused by the spring flange 10 and the downward inward pressure caused by the compression bar 20 combine to hold the first (e.g., bottom) row of siding 40 in a substantially rigid and fixed position.

While a preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claim that follows.

The embodiments of the invention in which an exclusive property or privilege is claimed are defined as follows:

1. A system for attaching first and second boards to a structure, comprising:

a rail fastened to the structure, the rail having an edge and a hole formed therethrough;

a first clip having a first portion, the first portion at least partially rounded and dimensioned to hold firmly in place a top edge of the first board and hold firmly in place a bottom edge of the second board, the first clip also having a second portion extending from the first portion, the second portion comprising an arm and a hook, the hole being dimensioned to receive the arm and hook therethrough, the hook, after being received through the hole, engaging the rail edge; and a second clip including a siding slot, a spring flange, a half pipe coupled to the spring flange, a siding seat coupled to the spring flange, and a hook-shaped siding set coupled to the siding seat, the siding slot dimensioned to engage the rail, the half pipe and the hole dimensioned to be coupled together by a single pin.

2. The system of claim 1, further comprising a third clip attachable to the rail and configured to support a second edge of at least one of the boards.

3. The system of claim 1, wherein the rail edge has a notch cut therein, and wherein the notch is dimensioned to receive and couple with the hook.

* * * * *